US010443327B2

(12) United States Patent
Frazier et al.

(10) Patent No.: US 10,443,327 B2
(45) Date of Patent: Oct. 15, 2019

(54) SEPARATOR AND METHOD OF SEPARATION WITH A PRESSURE DIFFERENTIAL DEVICE

(71) Applicant: M-I L.L.C., Houston, TX (US)

(72) Inventors: Evan T. Frazier, Covington, KY (US); Eric Cady, Florence, KY (US); Michael A. Timmerman, Cincinnati, OH (US)

(73) Assignee: M-I L.L.C., Houston, TX (US)

( * ) Notice: Subject to any disclaimer, the term of this patent is extended or adjusted under 35 U.S.C. 154(b) by 566 days.

(21) Appl. No.: 14/461,946

(22) Filed: Aug. 18, 2014

(65) Prior Publication Data

US 2015/0048037 A1 Feb. 19, 2015

Related U.S. Application Data

(60) Provisional application No. 62/004,752, filed on May 29, 2014, provisional application No. 61/945,824, filed on Feb. 28, 2014, provisional application No. 61/934,700, filed on Jan. 31, 2014, provisional application No. 61/909,163, filed on Nov. 26, 2013, provisional application No. 61/909,162, filed on Nov.

(Continued)

(51) Int. Cl.

| | |
|---|---|
| ***E21B 21/06*** | (2006.01) |
| ***B03B 5/04*** | (2006.01) |
| ***B07B 1/28*** | (2006.01) |
| ***B07B 1/46*** | (2006.01) |
| ***B07B 13/16*** | (2006.01) |

(52) U.S. Cl.

CPC ..... *E21B 21/065* (2013.01); *B07B 1/28* (2013.01); *B07B 1/46* (2013.01); *B07B 13/16* (2013.01)

(58) Field of Classification Search

CPC ..... E21B 21/065; E21B 21/06; B07B 1/28; B07B 1/46; B07B 13/16; B03B 5/04

USPC ..... 210/741, 808, 416.1

See application file for complete search history.

(56) References Cited

U.S. PATENT DOCUMENTS

| | | | |
|---|---|---|---|
| 3,154,805 | A | 11/1964 | Egee et al. |
| 4,272,369 | A | 6/1981 | Love |
| 4,350,591 | A | 9/1982 | Lee |

(Continued)

FOREIGN PATENT DOCUMENTS

| | | | |
|---|---|---|---|
| CA | 2712774 | C | 11/2010 |
| DE | 3927769 | C1 | 11/1990 |

(Continued)

OTHER PUBLICATIONS

International Search Report and Written Opinion issued in PCT/US14/51496 dated Nov. 24, 2014, 9 pages.

(Continued)

*Primary Examiner* — Robert Clemente
*Assistant Examiner* — Akash K Varma
(74) *Attorney, Agent, or Firm* — Jeffrey D. Frantz

(57) ABSTRACT

A separator having a pressure differential generating system is disclosed. The pressure differential generating system generates a pressure differential with respect to a screen of the separator. Fluid is supplied to the pressure differential generating device to generate the pressure differential across a screen of the separator. The separator can be utilized to separate drill cuttings from drilling fluid to increase an amount of drilling fluid recovered as a result of the pressure differential.

19 Claims, 10 Drawing Sheets

Related U.S. Application Data

26, 2013, provisional application No. 61/866,956, filed on Aug. 16, 2013.

(56) References Cited

U.S. PATENT DOCUMENTS

| | | | | |
|---|---|---|---|---|
| 5,098,586 | A | 3/1992 | Rodolph | |
| 5,595,654 | A | 1/1997 | Caughman, Jr. | |
| 5,944,195 | A | 8/1999 | Huang et al. | |
| 6,170,580 | B1 | 1/2001 | Reddoch | |
| 6,533,946 | B2 | 3/2003 | Pullman | |
| 6,910,411 | B2 | 6/2005 | Reddoch | |
| 6,988,622 | B1 | 1/2006 | Victor | |
| 7,704,299 | B2 | 4/2010 | Mueller et al. | |
| 7,727,316 | B2 | 6/2010 | Mueller et al. | |
| 8,025,152 | B2 * | 9/2011 | Vasshus | B01D 33/03 209/307 |
| 2002/0104806 | A1 | 8/2002 | Pullman | |
| 2004/0011749 | A1 | 1/2004 | Hutchinson et al. | |
| 2005/0082236 | A1 | 4/2005 | Derrick et al. | |
| 2005/0183994 | A1 | 8/2005 | Hensley | |
| 2008/0075606 | A1 * | 3/2008 | Krohn | F04F 1/02 417/307 |
| 2008/0078699 | A1 * | 4/2008 | Carr | E21B 21/065 209/233 |
| 2009/0301939 | A1 * | 12/2009 | Sorensen | B01D 33/0133 209/44.3 |
| 2011/0284481 | A1 | 11/2011 | Pomerleau | |
| 2012/0279932 | A1 * | 11/2012 | Pomerleau | B01D 29/117 210/785 |
| 2013/0074360 | A1 | 3/2013 | Pomerleau | |
| 2013/0105412 | A1 * | 5/2013 | Burnett | B07B 1/46 210/780 |
| 2017/0022771 | A1 | 1/2017 | Frazier et al. | |

FOREIGN PATENT DOCUMENTS

| | | | |
|---|---|---|---|
| EA | 013730 | B1 | 6/2010 |
| RU | 2061558 | C1 | 6/1996 |
| UA | 20835 | U | 1/2007 |
| WO | 2013101254 | A1 | 7/2013 |

OTHER PUBLICATIONS

International Search Report and Written Opinion for the cross referenced International patent application PCT/US2014/067625 dated Mar. 2, 2015.

International Preliminary Report on Patentability for the cross referenced International patent application PCT/US2014/067625 dated Jun. 9, 2016.

Extended Search Report for the equivalent European patent application 14836897.0 dated Mar. 28, 2017.

Office Action for the equivalent Russian patent application 2016109087/03 dated May 5, 2017.

Office Action for the equivalent Columbian patent application 16068677 dated Aug. 17, 2017.

Office Action for the equivalent Columbian patent application 16068677 dated Dec. 26, 2017.

Office Action for the equivalent Columbian patent application 16068677 dated Jun. 4, 2018.

Decision on Grant for the equivalent Russian patent application 2016109087/03 dated Aug. 29, 2018.

* cited by examiner

SEPARATOR AND METHOD OF SEPARATION WITH A PRESSURE DIFFERENTIAL DEVICE

CROSS-REFERENCE TO RELATED APPLICATIONS

This application claims the benefit of U.S. Provisional Patent Application No. 61/866,956 filed on Aug. 16, 2013; U.S. Provisional Patent Application No. 61/909,162 filed on Nov. 26, 2013; U.S. Provisional Patent Application No. 61/909,163 filed on Nov. 26, 2013; U.S. Provisional Application No. 61/934,700 filed on Jan. 31, 2014; U.S. Provisional Patent Application No. 61/945,824 filed on Feb. 28, 2014; and U.S. Provisional Patent Application No. 62/004,752 filed on May 29, 2014, and the disclosures of each provisional patent application identified is incorporated herein by reference in its entirety.

BACKGROUND

Various industries, such as oil and gas, mining, agriculture and the like utilize equipment and/or methods to separating fluids from materials. For example, in the mining industry, the separation of a desired mineral component from the undesirable gangue of an ore is a necessary and significant aspect of mining. Tailings are the materials left over after the process of separating the valuable ore from the gangue. Mine tailings are usually produced from a mill in slurry form that is typically a mixture of fine mineral particles and water.

Another example of such a separation method is found in the oil and gas industry. For example, oilfield drilling fluid, often called "mud," serves multiple purposes in the oil and gas industry. Among its many functions, the drilling mud acts as a lubricant for a drilling bit and increases rate of penetration of the drilling bit. The mud is pumped through a bore of the drill string to the drill bit where the mud exits through various nozzles and ports, lubricating the drill bit. After exiting through the nozzles, the "spent" fluid returns to the surface through an annulus formed between the drill string and the drilled wellbore. The returned drilling mud is processed for continued use.

Another significant purpose of the drilling mud is to carry the cuttings away from the drill bit to the surface. The drilling fluid exiting the borehole from the annulus is a slurry of formation cuttings in drilling mud, and the cutting particulates must be removed before the mud is reused.

One type of apparatus used to remove cuttings and other solid particulates from drilling mud is commonly referred to in the industry as a "shaker" or "shale shaker." The shaker, also known as a vibratory separator, is a vibrating sieve-like table upon which returning used drilling mud is deposited and through which substantially cleaner drilling mud emerges. Typically, the shaker is an angled table with a generally perforated filter screen bottom. Returning drilling mud is deposited at the top of the shaker. As the slurry moves toward a discharge end that may be higher than an inlet end, the fluid falls through the perforations to a reservoir below thereby leaving the solid particulate material behind. The combination of the angle of inclination with the vibrating action of the shaker table enables the solid particles left behind to flow until they fall off the lower end of the shaker table. The above described apparatus is illustrative of an exemplary shaker known to those of ordinary skill in the art.

Screens used with shakers are typically placed in a generally horizontal fashion on a generally horizontal support within a basket or tray in the shaker. The shaker imparts a rapidly reciprocating motion to the basket and hence the screens. Material from which particles are to be separated is poured onto a back end of the vibrating screen and may be conveyed along the shaker toward the discharge end of the basket.

In some shakers, a fine screen cloth is used with the vibrating screen. The screen may have two or more overlaying layers of screen cloth and/or mesh. Layers of cloth and/or mesh may be bonded together and placed over a support. The frame of the vibrating screen is suspended and/or mounted on a support and vibrates by a vibrating mechanism to create a flow of trapped solids on top surfaces of the screen for removal and disposal of solids.

DETAILED DESCRIPTION

Embodiments disclosed herein are applicable to separation devices that may be used in many industries. While specific embodiments may be described as used in the oilfield industry, such as use with vibratory separators, the device may also be applicable in other industries where separation of liquid-solid, solid-solid and other mixtures may be desirable. The embodiments, for example, may be used in mining, pharmaceutical, food, medical and/or other industries to separate mixtures as needed.

In the following detailed description, reference is made to accompanying figures, which form a part of the disclosure. In the figures, similar symbols or identifiers typically identify similar components, unless context dictates otherwise. The illustrative embodiments described herein are not meant to be limiting. Other embodiments may be utilized, and other changes may be made, without departing from the spirit or scope of the subject matter presented here. It will be readily understood that aspects of the present disclosure, as generally described herein, and illustrated in the Figures, may be arranged, substituted, combined and designed in a wide variety of different configurations, all of which are explicitly contemplated and form part of this disclosure.

Figure 1:
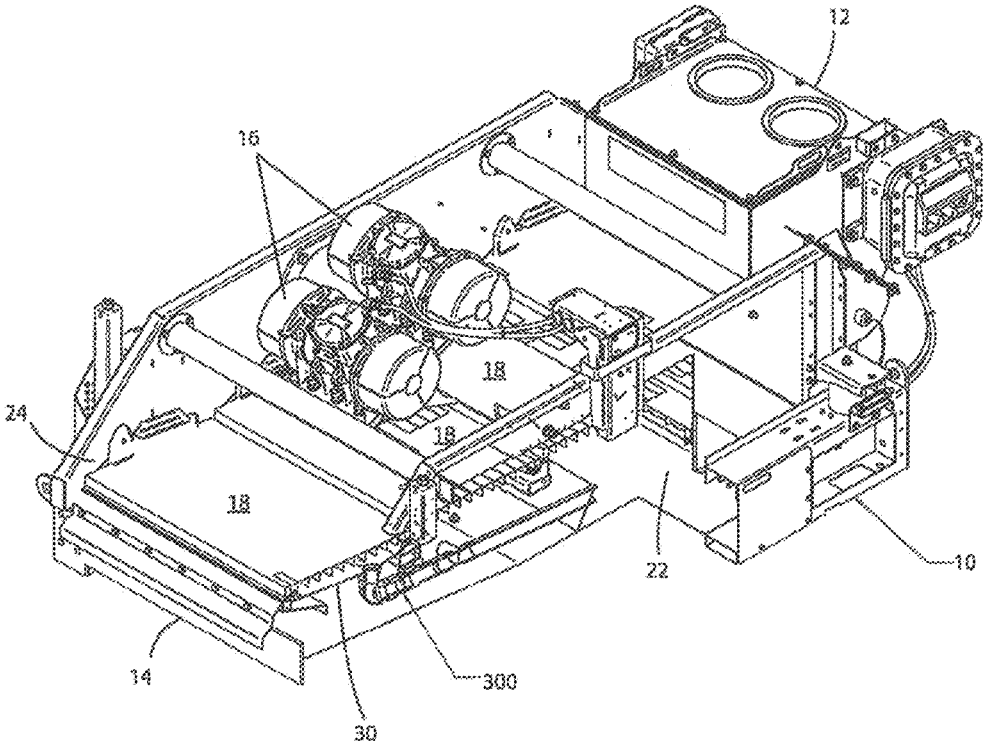
FIG. 1 illustrates a vibratory separator having screens usable with the pressure differential system in accordance with embodiments disclosed herein.

Referring now to FIG. 1, a separator 10 in accordance with the embodiments disclosed herein is illustrated. The separator 10 may have an inlet end or feed end 12 and an outlet end or discharge end 14 opposite the inlet end 12. A slurry may be provided to the separator 10 at the inlet or feed end 12. The slurry as used herein can include hydrocarbons, drilling fluid, weighting agents, water, lost circulation material and/or other fluids or substances present in the wellbore, such as the cuttings, gas, or oil. The slurry may have two or more portions that may be separated. For example, a first portion of the slurry can be sized to pass through the separator 10, such as liquid and/or solids below a predetermined size. A second portion of the slurry can be sized to be conveyed to the discharge end 14 and may include solids, such as rock or formation cuttings ("cuttings"). The separator 10 may have motors 16 to generate and/or impart vibrational motion to the separator 10, and screens 18 for separating the components of the slurry. The screens 18 may have a mesh stretched or tensioned on a metal, composite and/or other frame material. The slurry of may enter the inlet end 12 of the separator 10 and onto the screens 18. The slurry may be conveyed within the separator 10 toward the discharge end 14. The vibratory motion imparted by the motors 16 may aid in separating the slurry.

Figure 2:
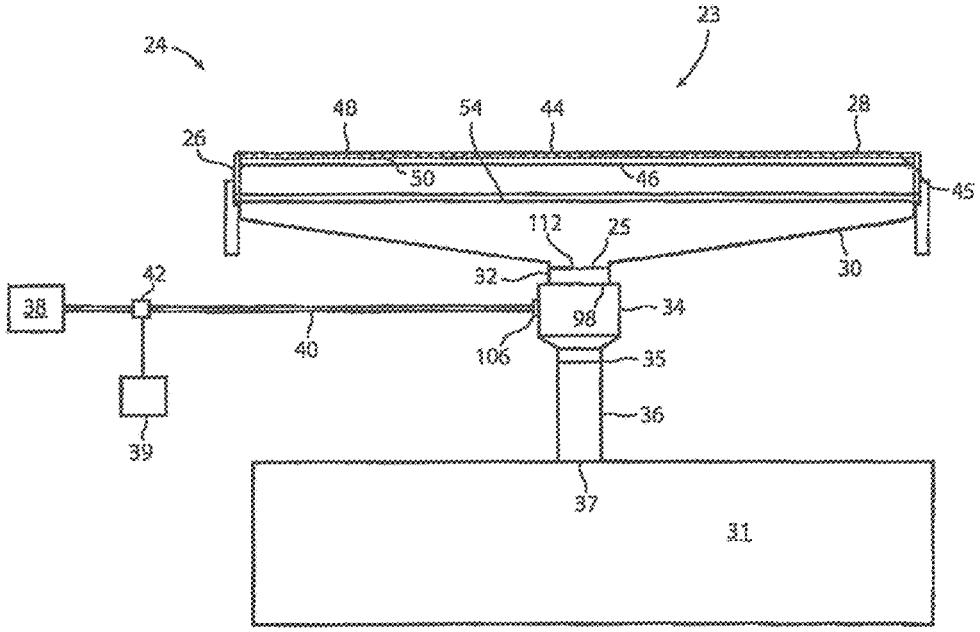
FIG. 2 illustrates a side view of a pressure differential system in accordance with embodiments disclosed herein.

FIG. 2 illustrates an embodiment of a pressure differential system 24 that may be secured to or connected to a separator, such as the separator 10 as shown in FIG. 1. The pressure differential system 24 may be secured to a vibrating basket 26 of the separator 10. The pressure differential system 24 may be secured or otherwise connected to the separator 10 at one or more of the screens 18, all of the screens 18, and/or a portion of one or more of the screens 18 of the separator 10.

The pressure differential system 24 may be connected to, sealed to or otherwise positioned under a screen 28. In an embodiment, the screen 28 can be one of the screens 18, shown in FIG. 1. The screen 28 may have a mesh 44 stretched or pre-tensioned across a frame 46. The mesh 44 may have a top surface 48 and a bottom surface 50. The mesh 44 may be a single layer of woven mesh wire or may be multiple layers of woven mesh wire. In an embodiment, the mesh 44 may have apertures of a predetermined size. For example, the size of the apertures may be selected to separate the first portion of the slurry from the second portion of the slurry, such as at least a portion of the wellbore fluid from the cuttings. Mesh size as used herein refers to the size of the apertures in the mesh 44. The first portion of the slurry, such as, at least a portion of the wellbore fluid and solids smaller than the size of the apertures of the mesh 44, may fall or move through the mesh 44 into a bottom (or sump) 22 of the separator 10. The second portion, such as drill cuttings larger than the apertures of the mesh 44, may be conveyed to the discharge end 14 of the separator 10. In an embodiment, the first portion of the slurry can pass through the screen 28, and the first portion may be the wellbore fluid and weighting agents or other solids smaller than the apertures in the screen 28. The first portion can be collected in the sump 22 located at the lower part (or in the bottom) of the separator 10. The second portion of the slurry, for example, may include solids with a size larger than a size of the apertures of the mesh 44 and wellbore fluid not separated from the cuttings. The cuttings separated from the wellbore fluid, for example, the first portion can be conveyed to the discharge end 14 of the separator 10, as shown in FIG. 1.

The pressure differential system 24 comprises a tray 30, a connection conduit 32, a pressure differential generating device 34 and/or an output conduit 36. The pressure differential system 24 may generate a pressure differential with respect to a top area 23 above the screen 28 and a bottom area 25 below the screen 28.

The pressure differential generating device 34 may be connected to a fluid source 38 through a conduit 40. The fluid source 38 can provide fluid, such as liquid or gas, for example, air, compressed air, nitrogen, carbon dioxide, wellbore fluid, drilling fluid or other fluids usable in the pressure differential generating device 34 to generate the pressure differential. The flow of fluid from the fluid source 38 to and/or through the pressure differential generating device 34 can cause the pressure differential across the screen 28. It should be noted that the movement of the fluid from the fluid source 38 through the pressure differential generating device 34 may provide motive force for air above the screen 28 to move into and through the pressure differential generating device 34. The motive force of the air moving through the pressure differential generating device 34 can cause or increase the pressure differential.

The pressure differential can increase separation of the slurry, such as additional fluid being removed from the cuttings that would otherwise be removed without the pressure differential. The pressure differential with respect to the top area 23 and the bottom area 25 of the screen 28 draws additional fluid from the slurry to pass through the screen 28. For example, the pressure differential can draw or pull additional fluid of the slurry through the screen 28. Where the slurry has the wellbore fluid and the cuttings, the additional wellbore fluid recovered can result in a lesser amount (or volume) of drill fluid being used, since, for example, the additional drilling fluid recovered may be processed and re-used. In addition, the additional wellbore fluid recovered can result in the cuttings on the discharge end 14 of the separator 10 being dryer, that is having less of the wellbore fluid contained on or within the cuttings. As a result, a total volume or amount of the wellbore fluid and the cuttings discharged from the discharge end 14 of the separator 10 may be reduced. Additionally, if oil based drilling fluid is within the slurry, the reduction of oil on cuttings can be significant from a disposal or further processing perspective.

A fluid control assembly 42 may be connected to the conduit 40 between the fluid source 38 and the pressure differential generating device 34. The fluid control assembly 42 may have logic and/or devices to actuate a device 39 to change or alter an amount of fluid provided to the pressure differential generating device 34. For example, the device may fully open, partially open, fully close or partially close fluid communication between the fluid source 38 and the pressure differential generating device 34.

In an embodiment shown by FIG. 2, the pressure differential system 24 may be connected to a container 31 through the output conduit 36. The container 31 may be the bottom or sump 22 of the separator 10 (shown in FIG. 1) or may be a container external to the separator 10, such as a holding tank, where the gas or air may be vented, separated or re-used as the fluid for the fluid source 28. The output conduit 36 may be flexible and have a first end 35 secured to the pressure differential generating device 34. A second end 37 of the output conduit 36 may be connected to the container 31.

Figure 3:
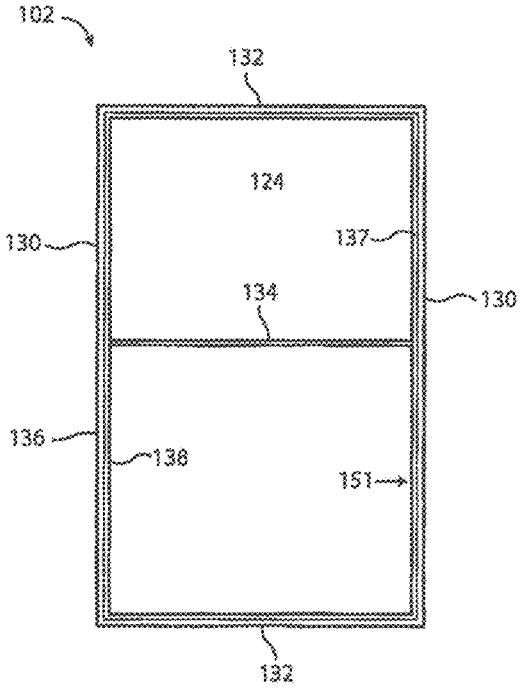
FIG. 3 illustrates a top view of a basket of the vibratory separator of FIG. 1 in accordance with embodiments disclosed herein.

FIG. 3 illustrates a basket 102 that may be secured or formed within the separator 10 of FIG. 1. The basket 102 may have a basket frame 124 comprising side rails 130 connected to end rails 132. The basket frame 124 may also have a cross member 134 parallel to the end rails 132. The cross member 134 may connect to the side rails 130 between the end rails 132. In an embodiment, the cross member 134 may connected to the side rails 132 at a point equidistant between the end rails 132. In an embodiment, the side rails 130 may be longer than the end rails 132 so the basket 102 has a generally or substantially rectangular shape. The side rails 130 and the end rails 132 may have a rim 136 that extends upwardly from the top 126 of the basket 102. The rim 136 and the top 126 of the basket 102 may form a ledge 138 around an inner perimeter 137 of the rim 136. The screen 28 and/or the tray 30 may be secured into or fluidly sealed to the ledge 138 within the inner perimeter 137.

Figure 4:
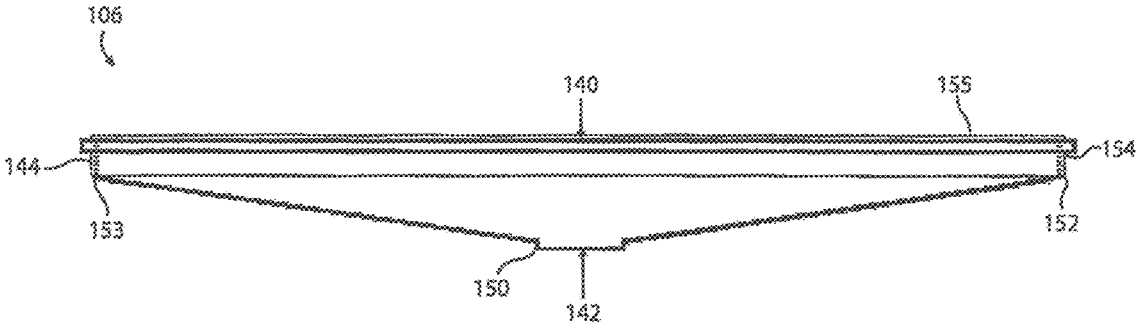
FIG. 4 illustrates a side view of a tray in accordance with the embodiments disclosed herein.
Figure 5:
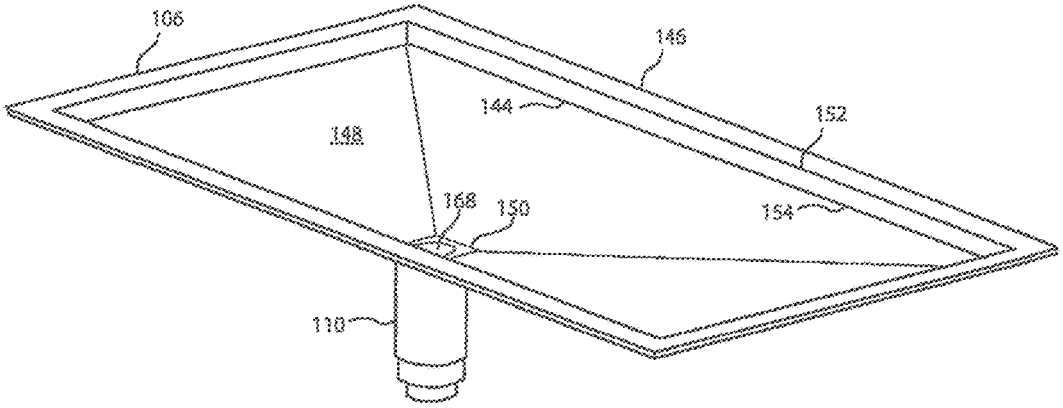
FIG. 5 illustrates a top isometric view of the tray in accordance with the embodiments disclosed herein.
Figure 6:
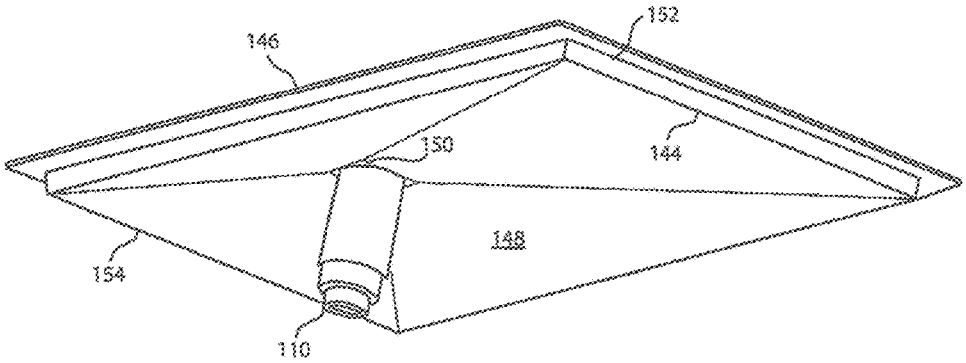
FIG. 6 illustrates a bottom isometric view of the tray.

As shown in FIGS. 4-6, the tray 106 may have a top 140, a bottom 142, a perimeter frame 144, a flange 146, a floor panel 148 and/or an interface panel 150. The perimeter frame 144 may have an upper circumferential edge 152 and a lower circumferential edge 154. The upper circumferential edge 152 may be located at the top of the tray 106. The flange 146 may extend outwardly from the upper circumferential edge 152 of the perimeter frame 144. The flange 146 may interface with the bottom of the basket 102. An interior wall 151 of the basket frame 124 may be flush with an interior 153 wall of the perimeter frame 144. A gasket 155 may be positioned between the basket 102 and the flange 146 to create a seal between the basket 102 and the tray 106. The gasket 155 may be positioned between the tray 106 and the screen 28. The basket 102 and the flange 146 of the tray 106 may be integrally formed so that the basket 102 and the tray 106 form a single assembly.

The floor panel 148 of the tray 106 may taper downwardly and inwardly from the lower circumferential edge 154 of the perimeter frame 144 towards the interface panel 150. The floor panel 148 may have a depth 154 defined between the lower circumferential edge 154 of the perimeter frame 144 and the bottom 142 of the tray 106. The interface panel 150 may be located at the bottom 142 of the tray 106. In an embodiment, the interface panel 150 may be located at the center of the floor panel 148. In another embodiment, as illustrated in FIG. 5 and FIG. 6, the interface panel 150 may be offset from the center of the floor panel 148.

The taper of the floor panel 148 may cause the portion of the slurry passing through the screen 28 to move towards the interface panel 150. The interface panel 150 may have an opening 168. The interface panel 150 may be connected to a first end 169 of the connection conduit 32. In an embodiment, the interface panel 150 and the connection conduit 32 may be formed as a single assembly. In another embodiment, the basket 102, the tray 106 and the connection conduit 32 may be integrally formed as a single assembly.

The basket 102 and the tray 106 may be installed on support rails 156 on one or more sides. The support rails 156 may be connected to, for example, an industrial filtration system by resilient mounts. The resilient mounts may be springs, hydraulic dampers, pneumatic isolators and/or any other device known to a person of ordinary skill in the art that may isolate vibration. The support rails 156 may be connected to one or more vibration motors. In an embodiment, a clamping system 158 may secure the support rails 156, the separating screen 104, the basket 102 and/or the tray 106.

Figure 11:
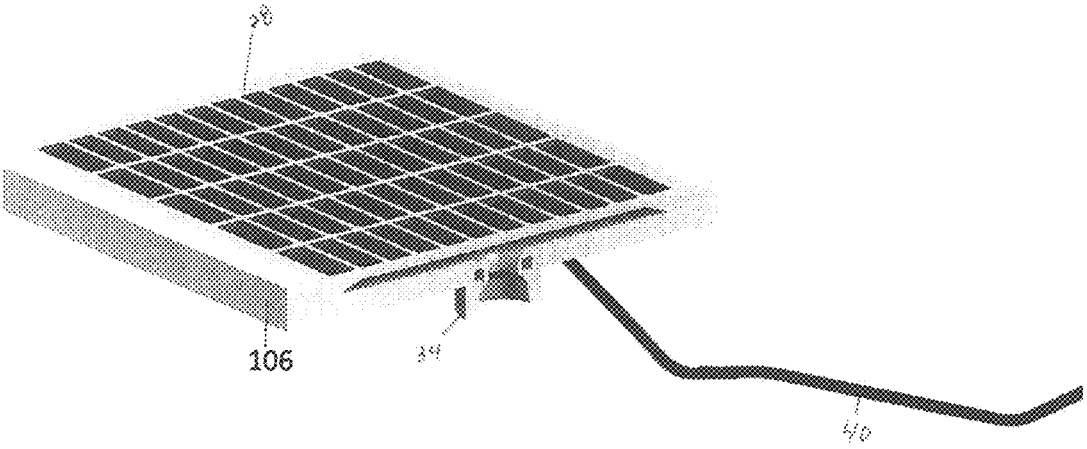
FIG. 11 illustrates a portion of a screen that may be integrally formed with a tray and/or pressure differential generating device in accordance with embodiments disclosed herein.
Figure 12:
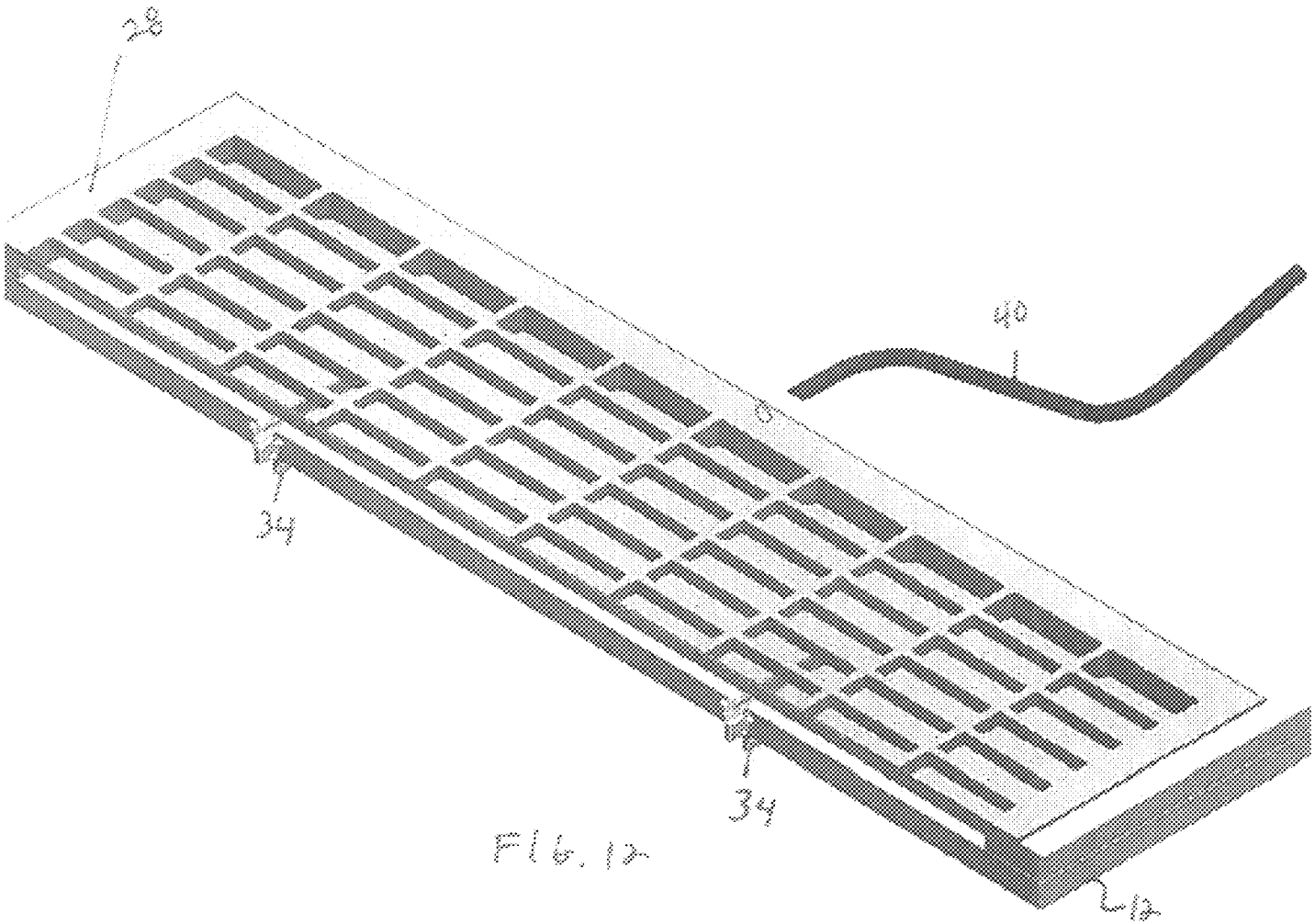
FIG. 12 illustrates a portion of a screen that can be integrally formed with multiple pressure differential generating devices in accordance with embodiments disclosed here.

FIGS. 11 and 12 illustrate embodiments of the tray 106, integrally formed with the pressure differential generating device 34. FIGS. 11 and 12 illustrate a cut-away of a portion of the screen 28, such as approximately half of the screen 28 severed between opposing sides of the screen. In an embodiment, the tray 106 may be made of a composite material, such as carbon fiber, glass fiber, glass filled plastic, and other similar materials. For example, a carbon fiber composite vacuum tray may include layers of carbon fiber material coupled together via a resin, adhesive, and/or other coupling material. The surfaces of the tray 106 and/or the pressure differential generating device 34 can be polished to reduce fluid from sticking or accumulating.

In an embodiment, the tray 106 and the pressure differential generating device 34 may be integrally formed with the screen 28 as shown in FIGS. 11 and 12. The tray 106, the pressure differential generating device 34, and the screen 28 may be molded together or may be constructed separated and coupled (e.g., fused) together. The pressure differential generating device 34 may be positioned anywhere within the perimeter of the tray 106 and/or the screen 28. FIG. 11 illustrates the pressure differential generating device 34 located substantially in the center of the screen 28. Alternatively, the tray 106 of FIG. 11 may have a conduit or threaded connection integrally formed with the tray 106. The conduit or the threaded connection may replace the pressure differential generating device 34 of the FIG. 11. The conduit or the threaded connection may then be connected to the pressure differential generating device 34. In some instances, fittings or threaded fittings may be molded onto the tray 106. In such an embodiment, the tray 106 and the screen 28 may be integrally formed or separate. FIG. 12 illustrates two of pressure differential generating devices 34 located near a center of the screen 28 in one direction and closer to a perimeter of the screen 28 in the other direction.

Figure 7:
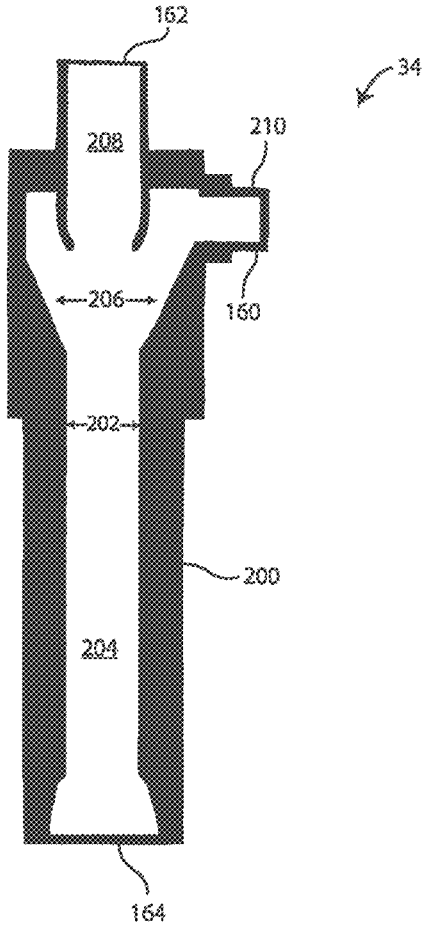
FIG. 7 illustrates a cross-section of a pressure differential generating device in accordance with the embodiments disclosed herein.

As shown in FIG. 7, the pressure differential generating device 34 may have a fluid injection port 160, an input 162 and an output 164. In an embodiment, a second end 98 of the connection conduit 32 may be connected to the pressure differential generating device 34. In another embodiment, the second end 98 of the connection conduit 32 may be integrally formed with the input 162 of the pressure differential generating device 34 to form one assembly. The floor panel 150 as shown in FIGS. 5 and 6 may connect to the input 162 of the pressure differential generating device 34. The pressure differential generating device 34 may have a body 200. The body 200 may have an axial bore 204 with a first inner diameter 206 and a second inner diameter 202. The body 200 may also have a nozzle 208 extending into the axial bore 204. The fluid injection port 106 may be attached to the body 200 so that a fluid canal 210 may be perpendicular to the axial bore 204. The axial bore 204 may taper from the first inner diameter 206 to the second inner diameter 202 between the fluid canal 210 and the output 164 of the pressure differential generating device 34. In an embodiment, the basket 102, the tray 106, and/or the connection conduit 32 may be integrally formed into a single assembly.

The pressure differential generating device 34 may be an air amplifier, line vacuum, or device having a structure to cause a Venturi effect, a particular case of Bernoulli's principle, upon the supply of fluid. The Venturi effect as used herein generally relates to increasing the velocity of the fluid provided from the fluid source 38 from a decrease in cross-sectional area in the pressure differential generating device 34. The fluid source 38, as shown in FIG. 2, may be connected to the fluid injection port 160 through the conduit 40. The fluid control assembly 42 may control the flow of fluid to the pressure differential generating device 34. The fluid control assembly 42 may be a ball valve, a solenoid or any other fluid control device suitable for controlling compressed gas.

The fluid may be injected into the fluid injection port 160. The fluid may reduce the available volume for particles and/or fluid entering the pressure differential generating device 34 through the input 162. A pressure change may be created between the input 162 and the output 164 of the pressure differential generating device 110.

Injecting the fluid into the pressure differential generating device 34 through the fluid injection port 160 may create a pressure change between the input 162 and the output 164 of the pressure differential generating device 34. The pressure change may create a low pressure area at the bottom area 25 of the separating screen 28. The low pressure area at the bottom area 25 may create a pressure differential between the top area 23 and the bottom area 25 of the screen 28. The pressure differential may assist and/or facilitate movement of a portion of the slurry, such as a portion of the wellbore fluid that may pass through the screen 28.

Figure 8:
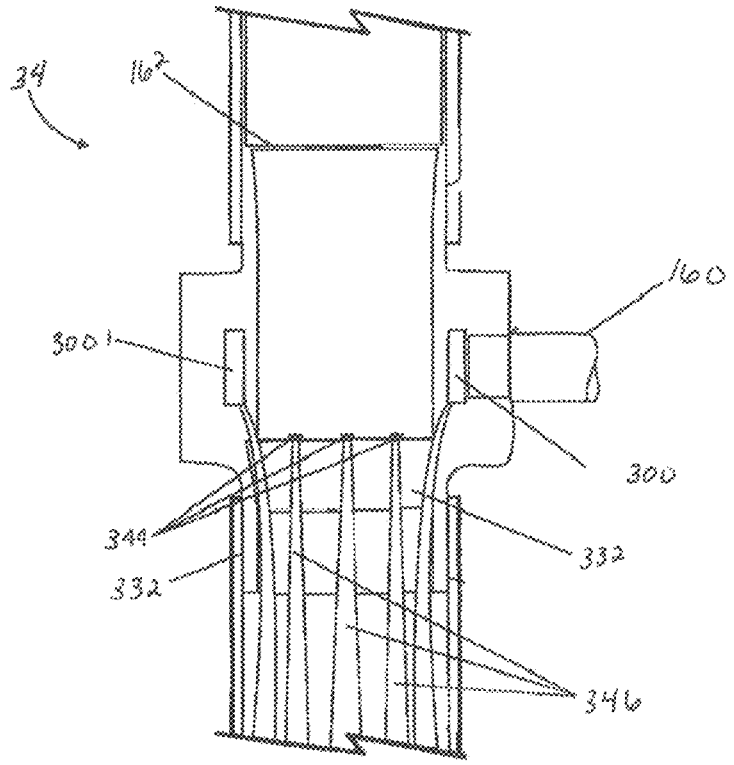
FIG. 8 illustrates a cross-sectional view of a pressure differential generating device in accordance with embodiments disclosed herein.

FIG. 8 illustrates an embodiment of the pressure differential generating device 34. The fluid from the fluid source 38 may flow through a fluid inlet 35 into an annular plenum chamber 300. The fluid may then be injected into the nozzles 344. As a result, the fluid flowing into the nozzles 344 may generate fluid jets 346. The fluid jets 346 may create the pressure differential across the screen 28. For example, the pressure differential generating device 34 may generate a pressure differential by narrowing orifices in which the fluid flows. The pressure differential generating device 34 may draw a portion of the slurry through the screen 28 and may accelerate the portion of the slurry to convey the slurry. The pressure differential generating device 34 may eject a small amount of the fluid to produce the pressure differential with a relatively higher output of the fluid at a discharge end 332 of the pressure differential generating device 34. The pressure differential generating device 34 may be constructed from aluminum, stainless steel, composite and/or another material. In an embodiment, the pressure differential generating device 34 may provide maintenance-free operation since the vacuum generator 30 may have no moving parts and/or may not require electricity to operate.

Figure 10:
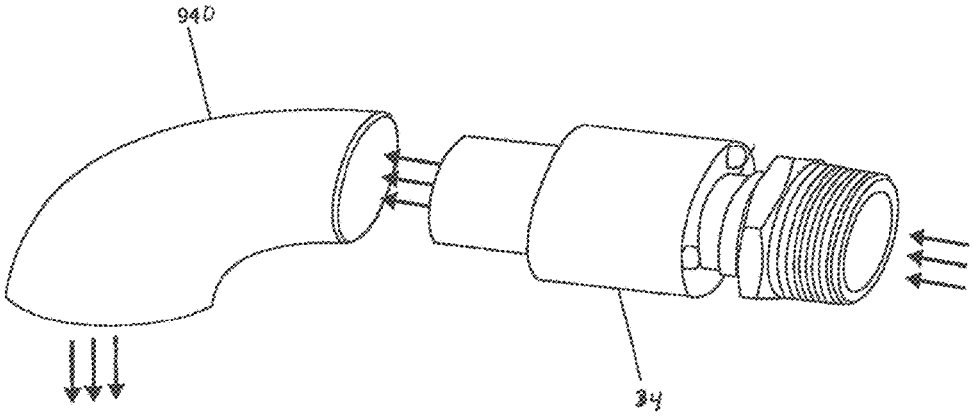
FIG. 10 illustrates a pressure differential generating device positioned between a screen or separator and a conduit in accordance with embodiments disclosed herein.

Referring now to FIG. 10, another embodiment of the pressure differential generating device 34 is illustrated. As shown, the pressure differential generating device 34 may be positioned horizontally to cause the fluid to reach a relatively high velocity and discharge from the pressure differential generating device 34. The fluid may enter into a conduit 940 that may be a tube, such as a long conduit or an oversized elbow to make use of the high velocity of the fluid to increase the pressure differential across the screen 28. The conduit 940 may be positioned a distance from the pressure differential generating device 34 or connected, such as directly connected, to the pressure differential generating device 34. In an embodiment, for a given flow rate of the fluid to the pressure differential generating device 34, the pressure differential generated may be greater with the conduit 940 than without the conduit 940. The conduit 940 may increase the motive force by providing an additional volume of the fluid moving through the pressure differential generating device 34.

The separator 10 may have a mass flow measurement device, such as a cutting flow meter, to monitor the mixture that may be delivered to the input end of the screen 28. The amount of fluid provided to the pressure differential generating device 34 may be changed to adjust for changing mixture density during filtering. For example, when the industrial filtration system filters drill cuttings from the drilling fluid, the size and/or the quantity of the drilling cuttings may change. Additionally, the density of the drilling fluid may change.

A larger pressure differential can increase or enhance separation of a portion of the slurry through the separating screen 28. For example, a slurry with a relatively high density may demand a larger or more significant pressure differential. Injecting or providing more fluid to the pressure differential generating device 34 may cause a larger pressure differential and may increase the throughput of the wellbore fluid that may pass through the mesh 44.

The pressure differential generating device 34 may be utilized to generate a constant pressure differential, or it may be utilized to pulse or vary the pressure differential with respect to time. In some instances, depending upon the pressure differential, a constant pressure differential may cause the portion of the slurry that does not pass through the mesh 44 to stall on the screen 28. The pressure differential may remain constant but be reduced to permit the portion of the slurry not passing through the screen 28 to convey toward the discharge end 14 of the separator 10. For example, less fluid may be provided to the fluid injection port 160 to reduce or lower the pressure differential.

In an embodiment, the pressure differential generated by the pressure differential generating device 34 may be toggled or pulsed by changing the amount of fluid provided to the pressure differential generating device 34. For example, the fluid control assembly 42 or the device 39 may control the fluid provided to the pressure differential generating device 34 to change the pressure differential from a first value to a second value. The first value may be higher than the second value. In some embodiments, the second value may be zero. In an instance where a minimal or no pressure differential is desired, further fluid may not be provided to the injection port 160 of the pressure differential generating device 34.

At the second value, for example, the pressure differential can permit the stalled portion of the slurry to move further toward the discharge end 14 of the separator 10. In an embodiment, changing the pressure differential from the first value to the second value may occur at predetermined intervals and/or may be controlled by the fluid control assembly 42. Additionally, the changes in the pressure differential can occur at irregular intervals and/or may be controlled by an operator.

A person having ordinary skill in the art will appreciate that there may be numerous values of the pressure differential. The portion of the slurry passing through the screens 18, 28 may continue to move into the tray 106 and through the pressure differential generating device 34 if the fluid provided to the pressure differential generating device 34 is temporarily reduced or halted.

The fluid control assembly 42 may be manually adjusted or automatically adjusted to control the amount of the fluid that may be injected or provided to the pressure differential generating device 34. An algorithm, software or other logic may control the pressure differential such that the value provided is optimized based on the density of the fluid, flow rate of the slurry at the inlet end 12, deck angle of the separator 10, speed or force of the motors 16, volume of slurry on the screen 18 closest to the inlet end 12 of the separator 10 or other factor that will be appreciated by those having ordinary skill in the art.

As an example, the second value may not generate sufficient pressure differential to draw any additional portion of the slurry through the screen 28 as compared to the portion of the slurry that moves through the screen 28 without the pressure differential. The second value may prime the pressure differential generating device 34 by continuous providing the fluid through the injector port 160. The second value may minimize performance degradation of the pressure differential generating device 34 caused by blinding or otherwise clogging or blocking the injector port 160. In some examples, the first value may have a pressure differential of 50-150 PSI. In some examples, the second value may have a pressure range of 0-50 PSI. The first value may be provided for a first duration, and the second value for a second duration. The first duration and the second duration may be the same or different.

The fluid control assembly 42 can control the first duration and the second duration. For example, the ratio between the first duration and the second duration may range from 1:1 (one unit of time for the first duration to one unit of time for the second duration) to 30:1 (thirty units of time for the first duration to one unit of time for the second duration) and may be biased toward either the first value or the second value.

In one or more embodiments, the fluid control assembly 42 may control the pressure differential generating device 34 to remove the maximum fluid portion of the slurry by maximizing resonance time on the screen 28 for a predetermined processing rate of the slurry. The predetermined processing rate may be related to the rate at which the slurry is provided to the separator 10 or a desired degree of separation of the slurry. For example, the predetermined processing rate may be a rate at which the separator 10 can process a given flow rate of the slurry and reduce fluid on cuttings of the slurry to less than a predetermined threshold.

Figure 9:
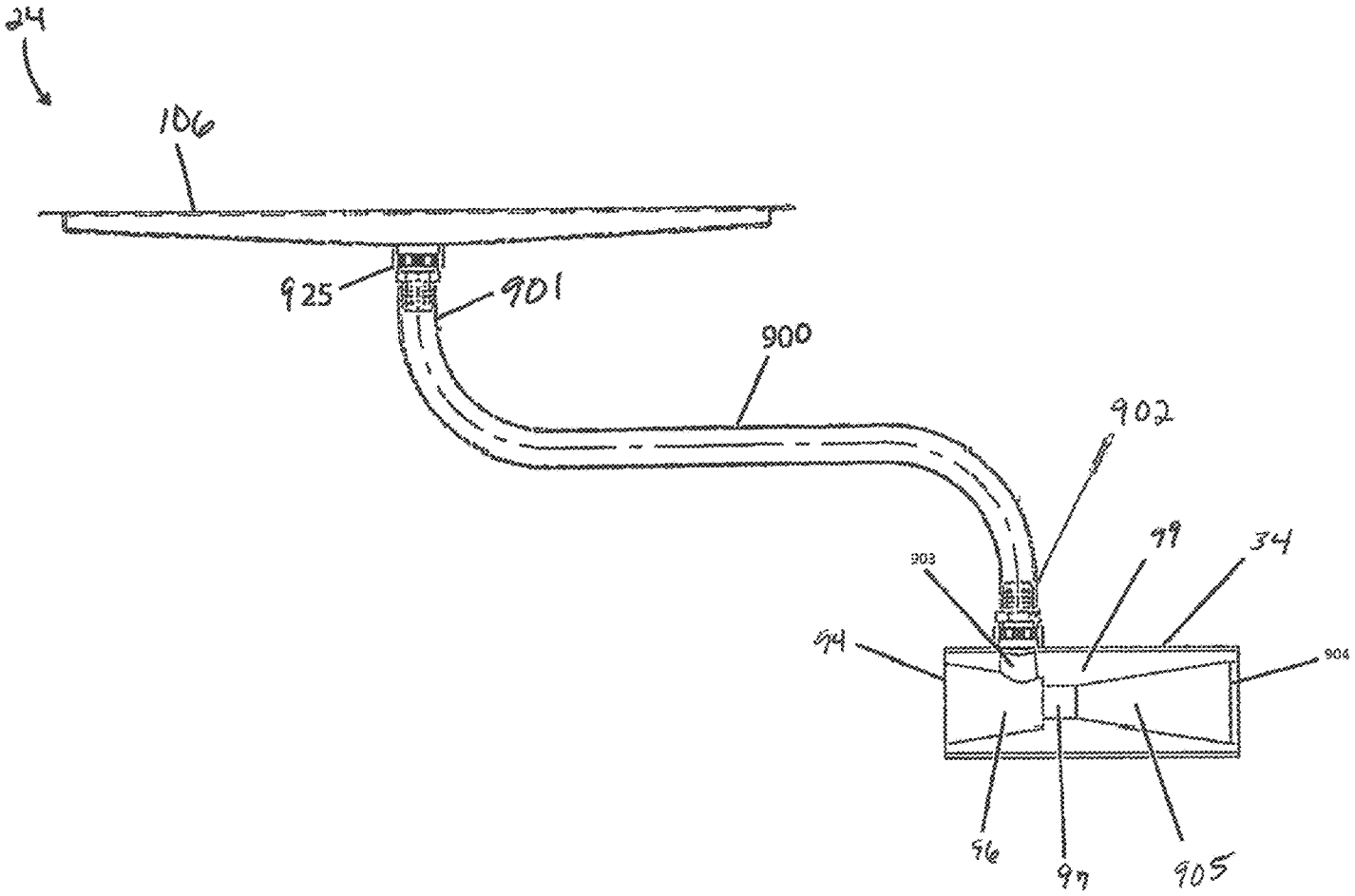
FIG. 9 illustrates a conduit or hose positioned between a tray and a pressure differential generating device in accordance with embodiments disclosed herein.

As shown in the embodiment illustrated in FIG. 9, the pressure generating differential device 34 may be located a distance from the tray 106 and/or the separator 10. The pressure differential generating device 34 may be connected by a conduit 900 to the pressure differential generating device 34, for example, by a fitting 925. The pressure differential generating device 34 may be positioned at a distance from the tray 106, screen 28 and/or separator 10 substantially equal to the length of the conduit 900. The conduit 900 may be a single or multi-piece or multi-component tube, hose, pipe or other device for transporting fluid. A first end of the extraction hose 39 may connect to the fitting 925, and a second end 902 of the extraction hose 925 may be connected to the pressure differential generating device 34. Access to the vacuum generator 30 may be improved by the remote location of the pressure differential generating device 34. As shown in FIG. 9, an auxiliary extraction hose 59 may be connected to the second end 32 of the vacuum generator 30.

In the embodiment of FIG. 9, the pressure differential generating device 34 may have a motive inlet 904, an inlet 903 for the slurry, and an outlet 94. The fluid may move through the motive inlet 904 into an inlet nozzle 905 and an outlet diffuser 96. The inlet nozzle 905 may be converging and the outlet diffuser 96 may be diverging to thereby form a convergent-divergent nozzle 99. In an embodiment, the pressure differential generating device 34 may be an ejector or a jet pump, such as an eductor-jet pump.

The converging-diverging nozzle 99 may utilize the Venturi effect to convert the pressure energy of the fluid to velocity energy which creates a low pressure zone that draws in the slurry passing through the screen 28. After passing through a throat 97 of the pressure differential generating device 34, the fluid and the slurry may expand, and the velocity may reduce which may result in recompressing the fluid and the slurry by converting velocity back into pressure energy.

The fluid provided to pressure generating differential device 34 may be any of the afore-mentioned fluids. Advantageously, the embodiment of FIG. 9 may be advantageous if the fluid is a liquid, such as drilling fluid or the wellbore fluid. The fluid may be used as a motive fluid in the pressure differential system 24 for generating the pressure differential.

The fluid source 38 to provide the motive force may utilize pumps, such as, a positive displacement pump, a momentum transfer pump or an entrapment pump, reciprocating pump, centrifugal pump, vacuum pump, pneumatic pump, air pump, piston pump, rotary piston pump, rotary vane pump, screw pump, scroll pump, liquid ring pump, external vane pump, Wankel pump, Toepler pump, and Venturi vacuum pump, and others. Blowers may be utilized at the fluid source 38, such as, a booster pump, a rotary lobe blower, and a vacuum blower. The fluid source 38 may utilize ejectors or aspirators, such as steam ejectors, water aspirators, or ejectors and aspirators utilizing other motive fluids. In some embodiments, drilling fluid may be used as the motive fluid for the pressure differential generating device 34.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the present disclosure should be limited only by the attached claims.

The invention claimed is:

1. A system comprising:

a separator having an inlet end and a discharge end;

a screen connected to the separator to separate a first portion from a second portion of a slurry, wherein the first portion is passable through the screen;

a pressure differential generating device in first fluid communication with the screen via an input of the pressure differential generating device; and a fluid source that is (i) distinct from the first portion that is passable through the screen, and (ii) in second fluid communication with the pressure differential generating device via a port of the pressure differential generating device that is separate from the input of the pressure differential generating device, wherein the first fluid communication between the screen and the pressure differential generating device provided by the input is distinct and separate from the second fluid communication between the fluid source and the pressure differential generating device provided by the port, and further wherein, via the second fluid communication, the fluid source provides a fluid to the pressure differential generating device to generate a pressure differential with respect to a top area and a bottom area of the screen and, via the first fluid communication, the generated pressure differential draws the first portion of the slurry through the screen and conveys the first portion, comprising drilling or wellbore fluid, through the pressure differential generating device.

2. The system of claim 1 wherein the fluid is air or compressed air.

3. The system of claim 1 further comprising:

a tray positioned under the screen wherein the pressure differential generating device is connected to the tray.

4. The system of claim 3 wherein the tray collects the drilling or wellbore fluid passing through the screen and directs the fluid into and through the pressure differential generating device.

5. The system of claim 3 wherein the tray is integrally formed with the pressure differential generating device.

6. The system of claim 3 wherein the tray is integrally formed with the screen and further wherein the tray and the screen comprise composite material.

7. The system of claim 3 wherein the tray is integrally formed with a fitting, and further wherein a conduit is secured to the fitting and the pressure differential generating device.

8. The system of claim 3 further comprising a conduit connected to the tray and the pressure differential generating device.

9. The system of claim 8 wherein the conduit is positioned between the tray and the pressure differential generating device.

10. The system of claim 8 wherein the pressure differential generating device is secured between the tray and the conduit.

11. The system of claim 1 wherein the pressure differential generating device comprises a structure configured such that flow of the fluid through the pressure differential generating device causes a Venturi effect upon the fluid from the fluid source to provide the pressure differential across the screen.

12. The system of claim 1 wherein the fluid is directed to an injection port in the pressure differential generating device to create the pressure differential.

13. The system of claim 1 further comprising:

a sump in fluid communication with the pressure differential generating device to receive the fluid passing through the screen and the pressure differential generating device.

14. A method comprising:

arranging a screen between an inlet end of and a discharge end of a vibratory separator;

distributing a slurry having a wellbore fluid and cuttings on the screen;

flowing a fluid within an interior of a pressure differential generating device via a port of the pressure differential generating device;

generating a pressure differential between an area above the screen and an area below the screen as a result of a change in velocity of the fluid flowing in the interior of the pressure differential generating device;

drawing the wellbore fluid through the screen toward the pressure differential generating device via an input of the pressure differential generating device;

passing the wellbore fluid through the interior of the pressure differential generating device, wherein the input provides first fluid communication to the pressure differential generating device, the port provides second fluid communication to the pressure differential generating device and the second fluid communication to the pressure differential generating device is distinct and separate from the first fluid communication to the pressure differential generating device such that the fluid flowing within the interior of the pressure differential generating device is distinct from the wellbore fluid drawn through the screen and the pressure differential generating device.

15. The method of claim 14 further comprising:

directing the fluid and the wellbore fluid into the pressure differential generating device.

16. The method of claim 14 further comprising:

altering the pressure differential by altering an amount of fluid provided to the pressure differential generating device.

17. The method of claim 14 further comprising:

pulsing the pressure differential between a first amount of pressure differential and a second amount of pressure differential wherein the second amount is zero and the first amount is greater than zero.

18. The method of claim 14 wherein the pressure differential generating device is remote from the screen.

19. The system of claim 1, wherein the fluid source is external to the separator.

* * * * *